US006837497B2

(12) United States Patent
Barnett

(10) Patent No.: US 6,837,497 B2
(45) Date of Patent: Jan. 4, 2005

(54) WESTERN HERITAGE RANCH SPORTS EVENT

(76) Inventor: Joe T. Barnett, 2234 Phelps Rd., Courtland, MS (US) 38620

( * ) Notice: Subject to any disclaimer, the term of this patent is extended or adjusted under 35 U.S.C. 154(b) by 0 days.

(21) Appl. No.: 10/294,574

(22) Filed: Nov. 15, 2002

(65) Prior Publication Data

US 2004/0094897 A1 May 20, 2004

(51) Int. Cl.[7] ..... A63B 71/02
(52) U.S. Cl. ..... 273/445; 273/459
(58) Field of Search ..... 273/440, 441, 273/444, 445, 446, 447, 459; 119/702, 174, 422, 436, 502, DIG. 905

(56) References Cited

U.S. PATENT DOCUMENTS

| | | | | | |
|---|---|---|---|---|---|
| 2,610,854 | A | * | 9/1952 | Card | 273/244 |
| 2,819,900 | A | * | 1/1958 | Brackett | 273/366 |
| 3,047,295 | A | * | 7/1962 | Sachs | 446/236 |
| 3,545,407 | A | | 12/1970 | Moore | |
| 3,711,098 | A | | 1/1973 | McCord | |
| 3,997,157 | A | * | 12/1976 | Meyer | 273/440 |
| 4,136,874 | A | * | 1/1979 | McCord | 273/339 |
| 4,165,712 | A | * | 8/1979 | Crowley, Jr. | 119/174 |
| 4,266,779 | A | | 5/1981 | English | |
| 4,432,553 | A | | 2/1984 | Moore | |
| 4,960,076 | A | | 10/1990 | Snorgrass et al. | |
| 5,080,373 | A | * | 1/1992 | Jones | 273/338 |
| 5,255,629 | A | | 10/1993 | Paterson | |
| 5,325,817 | A | | 7/1994 | Huffman | |
| 5,398,941 | A | | 3/1995 | Paulson | |
| 5,816,578 | A | * | 10/1998 | Frankamp et al. | 273/367 |
| 5,826,412 | A | * | 10/1998 | Harrell et al. | 54/1 |
| 6,293,548 | B1 | | 9/2001 | Swyers et al. | |
| 2002/0108584 | A1 | | 8/2002 | Van Der Lely et al. | |

OTHER PUBLICATIONS

"Rules and Regulations for Herding". Australian National Kennel Council [online]. Jan. 1, 2001 [retrieved on Jan. 7, 2004]. Retrieved from Internet: <URL:www.rnswcc.org.au/herding.pdf>.*

"Reined cow horse: the art of western training". Horsecity-.com [online]. copyright 2000–2004 [retrieved on Jan. 7, 2004]. Retrieved from Internet: <URL: www.horsecity.com/stories/021903/wef_artofwestern_BB.shtml>.*

"Herding Dog Commands and Rules". Meeker Classic Sheepdog Championship Trials [online]. copyright 2001–2003 [retrieved on Jan. 7, 2004]. Retrieved from Internet: <URL: www.meekersheepdog.com/event.htm>.*

Internet Site www.pendletonroundup.com, "The Rodeo Events of the Pendleton Round–Up," Printed Sep. 2002.

* cited by examiner

*Primary Examiner*—Raleigh W. Chiu
(74) *Attorney, Agent, or Firm*—Richard C Litman

(57) ABSTRACT

A western heritage ranch sports event includes elements which test horsemanship and other skills of the participants. The present event requires that one or more preselected herd animals (e.g., cows or calves) be cut or culled from a herd located at one end of an arena, and then driven or herded by the contestant(s) for the length of the arena, perhaps along a predetermined route, to a goal gate or enclosure. The object is to achieve this in the lowest total elapsed time. When more than a single competitor is participating, the competitors act as a team. More than one herd animal may be used as desired, with time credit given for successfully cutting and herding more than one animal. While roping the animals is not required, successful roping of the animals provides an additional time credit for the contestants, with unsuccessful roping attempts resulting in a time penalty.

7 Claims, 6 Drawing Sheets

WESTERN HERITAGE RANCH SPORTS EVENT

BACKGROUND OF THE INVENTION

1. Field of the Invention

The present invention relates generally to competitive athletic events, and more particularly to an event wherein one or more mounted riders cull one or more animals (e.g., cattle) from a herd or pen at one end of an arena, and herd or drive the animal(s) through a course or the length of the arena, and through a goal or into a pen at the opposite end of the arena. The event, which I prefer to call the "Cow Catch Event," is timed, with certain time credits or penalties administered for various actions by the competitors during the event. While the present event may be held in connection with a rodeo and its series of events, it may also be held as a stand-alone competition or event.

2. Description of the Related Art

While most competitive athletic events originate from leisure games or activities, western heritage events (such as those performed at rodeos and similar competitions) have strong ties to actual tasks required of the cowboy or ranch hand in working cattle, breaking and training horses, and other duties required in such work. The age of the cowboy and cattle drives in the late 1800s is still looked upon as a romantic era in the U.S., but most of the tasks required of the cowboy in that era must still be performed today, depending upon the conditions and environment. Accordingly, such events have proven to be popular competitive activities for the skilled performer, as well as being a popular spectator event.

As a result of the desire to demonstrate and/or test the skills needed of a skilled and experienced cowboy or ranch hand, the rules of various western heritage events tend to require contestants to demonstrate such skills as saddle and bareback riding, and individual and team roping, as well as bull riding and various types of racing events. Most all such events are timed, with riding events requiring the rider to remain seated for a minimum time and with the lowest elapsed time winning in roping and racing events, depending upon any penalties which might be assessed.

One activity or task which is required of the cowboy in the classic cattle roundup or cattle drive environment, is the selecting or cutting of one or more head of cattle from a herd, and driving those selected cattle to a specific location to be caught or contained for branding, veterinary treatment, loading on a vehicle for transport, or other purpose as required. Yet, this specific task has no direct competitive counterpart in the various western heritage or rodeo events known to the present inventor. While such events as individual and team calf roping and steer roping test the abilities of the contestants to capture and secure an animal, those rules do not require the animal to be herded from a first designated location to a designated second or goal location, through a predetermined course or route.

Accordingly, the present invention responds to this need, by providing a competitive western heritage ranch sports event which requires the contestants to separate one or more herd animals (e.g., cattle) from a group or herd, drive the selected animal(s) from the pen for the length of the arena, and through or into a designated goal gate or enclosure. In one embodiment of the present event, obstacles may be placed in the arena, around which the animals must be herded. The present competitive event thus tests multiple skills of the contestants, including horsemanship, teamwork where two (or possibly more) contestants are working as a team, roping skills where they are used, and perhaps other skills as well. The present event thus adds a realistic series of tests of the skills of the cowboy or ranch hand in catching and/or herding cattle or other herd animals, as is often required in the field.

A discussion of the related art of which the present inventor is aware, and its differences and distinctions from the present invention, is provided below.

U.S. Pat. No. 3,545,407 issued on Dec. 8, 1970 to William T. Moore, titled "Animal Pen," describes an enclosure constructed of a series of identical fence sections. The enclosure is partitioned by additional sections, with a series of swinging gates between sections to control the movement of animals therebetween. Animals are herded into progressively smaller or narrower sections until they travel down a control chute, where they may be confined for branding, etc. or moved to a loading platform for transport. The Moore disclosure does not describe any form of competitive activity associated with his pen or enclosure, and the generally central division of his enclosure teaches away from the necessarily open central area of an arena, which is required for operation of the present western heritage ranch sports competitive event.

U.S. Pat. No. 3,711,098 issued on Jan. 16, 1973 to Kenneth J. McCord, titled "Portable, Mechanical Lasso Training Apparatus," describes a system comprising a winch and a mechanical simulated animal resembling a small cow or calf. The simulated animal target includes a mechanism which may be used if desired to alter its path from a straight line, when towed by the winch. The winch draws the simulated cattle target over the surface, with a person practicing roping attempting to lasso the winch drawn target as it is drawn over the surface. McCord does not provide any rules for a competitive event in his disclosure, nor does he provide any form of enclosure, course, or actual cattle or other herd animals which must be herded over a predetermined course, as is done according to the competitive event of the present invention.

U.S. Pat. No. 4,266,779 issued on May 12, 1981 to Jackie L. English, titled "Animated Roping Training Apparatus," describes an apparatus intended for the same purpose as that of the McCord '098 U.S. Patent discussed immediately above. The English apparatus differs from the McCord device, in that English secures the object simulated animal to the horse upon which the roper is mounted, via a rope and a series of pulleys, and uses the motion of the horse to move the simulated animal away from the horse and mounted rider. While English provides some additional mechanisms for the simulated animal to provide further realism in its motion, he does not provide any form of enclosure or competitive rules for an event involving the herding and confining of live animals, as provided by the present competitive event.

U.S. Pat. No. 4,432,553 issued on Feb. 21, 1984 to Hazel M. Moore, titled "Cowboy Rodeo Contest Game," describes a board game in which the conventional rodeo events, i.e., saddle bronc riding, bareback riding, bull riding, calf roping, steer wrestling, and barrel racing, are provided. The Moore game is strictly a leisure pastime board game, with no athletic skills or abilities to perform any of the listed activities or events, being required for play of the game. Moreover, Moore does not list any event which appears to relate to the skills required for culling or separating one or more cattle from a herd, and then herding or driving those cattle from one area to another via a predetermined route, in accordance with the rules of the present competitive western heritage event.

U.S. Pat. No. 4,960,076 issued on Oct. 2, 1990 to Patrick R. Snorgrass et al., titled "Mechanical Roping Calf," describes another device serving the same function as those of the McCord '098 and English '779 U.S. Patents, described further above. The Snorgrass et al. device includes a central pylon, from which an elongated rod extends radially with the mechanical simulated calf secured to the distal end thereof. The mechanical calf has a electric motor therein for motive power, with power being supplied through conductors extending from the pylon through the radial rod. Snorgrass et al. also provide switches to shut off the device in the event the head or rear legs are successfully roped. While it thus appears that the Snorgrass et al. apparatus might provide training for the team roping type event, Snorgrass et al. do not disclose any competitive rules nor apparatus for competition.

U.S. Pat. No. 5,255,629 issued on Oct. 26, 1993 to Jerry Paterson, titled "Rider Remote-Controlled Cutting Horse Trainer," describes a mechanical calf simulation which moves back and forth on tracks. While the mechanical calf is actuated by cables which run along the tracks to produce the desired motion, control of the device is via a radio control transmitter which is operated by the mounted rider. The object of the Paterson device is to train the horse in the nearly automatic movements required of a cutting horse in the separation and control of a cow or calf from a herd. While the Paterson apparatus might be used to train cutting horses which might then be used by riders in the present competitive event, there is no disclosure by Paterson of any form of competitive event, or rules therefor, with his apparatus.

U.S. Pat. No. 5,325,817 issued on Jul. 5, 1994 to Steven K. Huffman, titled "Animal Training Apparatus," describes an apparatus serving the same purpose as that of the above noted Paterson '629 U.S. Patent. The Huffman device differs in its structure and principle of operation, by incorporating a pneumatic tube with a magnetically attractive piston therein. A magnetically attractive, external carriage rides on the tube, with a simulated calf suspended therefrom. When air is introduced to either end of the tube, the piston is pushed through the tube, thereby causing the carriage and simulated calf to move in concert with the piston. A trainer mounted on the horse being trained, controls the apparatus via radio, similarly to the control of the Paterson '629 device. Huffman does not disclose any rules for a competitive event.

U.S. Pat. No. 5,398,941 issued on Mar. 21, 1995 to Rodney L. Paulson, titled "Method For Conducting Racing Events," describes a system wherein competitors are placed in lanes of a race track in accordance with predetermined speed rankings. A series of heats or races are run, with the competitors being placed in different lanes for each heat or race. Winning times are determined for each race or heat, with the times for each competitor being compared against one another to determine the overall winner. While the Paulson system is applicable to speed competitions of various sorts, Paulson does not disclose any apparatus which is adaptable for use an any form of western heritage or rodeo competition, nor does he provide any rules for such a competition. Paulson is thus not particularly closely related to the invention of the present western heritage ranch sports competitive event.

U.S. Pat. No. 6,293,548 issued on Sep. 25, 2001 to John Swyers et al., titled "Method And System For Conducting Races," describes a system in which racers are ranked according to qualifying, with the race order being set in inverse order of qualifying. Competitors are then awarded points according to the number of other competitors passed during the event, and finishing points according to the order of finish. All of the qualifying, passing, and finishing points are combined for each competitor according to a mathematical formula, with the best score as determined by the formula, determining the winner of the event. The Swyers et al. system thus compares more closely to the system disclosed by Paulson in his '941 U.S. Patent, discussed immediately above, than it does to the present western heritage competitive event.

U.S. Patent Publication No. 2002/108,584 published on Aug. 15, 2002 to Alexander van der Lely et al., titled "Arrangement For And A Method Of Managing A Herd Of Animals," describes an automated system particularly adapted for use in automated milking barns and similar dairy or other farms. The van der Lely et al. system utilizes a complex series of automated detectors and a central processing system, which has been programmed with the characteristics of the animals using the facility. For example, when a dominant animal attempts to block other animals from entering a feeding station, the system precludes the entry of other animals into the system until the dominant animal has cleared, thus streamlining the entire operation. While the van der Lely et al. system may be advantageous for a dairy operation or the like, it does not provide any form of rules or apparatus adaptable to a western heritage event, as provided by the present invention.

Finally, a printout from the Internet site WWW PENDLETONROUNDUP.COM/EVENTS.HTM, located and printed on Sep. 25, 2002, provides a description of a series of rodeo events which take place annually at the Pendleton, Oregon rodeo. The various events, i.e., bareback, saddle, and bull riding, calf, team, and steer roping, and various racing events, are well known throughout the rodeo industry and are accepted events of the Professional Rodeo Cowboys' Association (PRCA). Of these various events, the team roping event is most closely related to the present western heritage competitive event. However, team roping differs in many aspects from the present event, in that team roping releases a single cow or steer from an enclosure, with the team only allowed to start after the animal when it reaches a certain point out of the starting gate or enclosure. The team does not select and cut or cull an animal from a herd, as is the case with the present event. Moreover, the elapsed time in a team roping event ends when both the header and heeler (the contestants roping the head and hind legs of the animal, respectively) have successfully roped the animal. There is no provision for herding the animal the length of the arena or about a predetermined course, nor for herding the animal through a goal gate or into a goal enclosure or pen, as is required in accordance with the rules of the present western heritage ranch sports event. Thus, team roping, as well as other roping events, test only a fraction of the skills required by cowboys in the herding and control of animals, whereas the present competitive event tests a much larger part of those skills. In addition, while roping is permitted in accordance with the rules of the event of the present invention, and in fact results in a better score if accomplished successfully, there is no requirement for such roping according to the rules of the present event. In fact, the competitors in the present event are not required to carry ropes, if they do not wish to.

None of the above inventions and patents, taken either singularly or in combination, is seen to describe the instant invention as claimed. Thus a competitive western heritage ranch sports event solving the aforementioned problems is desired.

SUMMARY OF THE INVENTION

The present invention is a western heritage ranch sports competition which may be performed or presented as a stand alone event, or as an event at rodeos and the like, where various events are held which challenge the skills and abilities of performers in various activities or tasks required of cowboys and ranch hands in the field. The western heritage event of the present invention is new, and differs from known events and competitions in that it requires competitors to demonstrate and utilize a variety of skills, particularly horsemanship, in selecting or cutting herd animals (e.g., cattle) from a group or herd, and herding or driving those selected animals the length of the arena or through a predetermined course to a goal. Roping the herd animals is not a requirement of the present competition, although it may be done to provide a better score for the contestants.

The present event is adaptable to participation by one or two contestants at a time, with two contestants forming a team. One or two cattle (or other animals) may be herded or driven at a time, as desired, with higher scores provided for driving more than a single animal. (While more than two competitors and animals may participate, such additional contestants and animals are not desirable, due to the added complexity of the event and the likelihood of excessive time requirements to drive more than two animals over the predetermined course.) Slightly different rules (e.g., animal selection means, starting point and time, etc.) may be provided for different phases of the event, or for different events, as desired. The lowest elapsed time wins the event.

Accordingly, it is a principal object of the invention to provide a competitive western heritage ranch sports event which tests a number of different skills of the contestants, with horsemanship being a prime requirement.

It is another object of the invention to provide such a western heritage event which requires contestants to cut or cull one or more preselected animals from a herd, and drive or herd the selected animals from a starting enclosure, through or along a predetermined route or course, and through a goal or into a goal enclosure.

It is a further object of the invention to provide such a western heritage event which is particularly adaptable for participation by either one or two contestants, with two contestants forming a team and working simultaneously, and in which either one or two herd animals may be selected for use during the competition.

Still another object of the invention is to provide such a western heritage event in which contestants have the option of roping the animal(s) for a better score, with a missed roping attempt resulting in a time penalty.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a competitive western heritage ranch sports event, in which competitors are required to select or cull one or more herd animals (e.g., cattle) from a small herd, separate those selected animals from the rest of the herd, and drive the selected animals through a predetermined course and through a goal at the opposite end of the arena. Contestants are timed during the event, with the lowest elapsed time winning the event. Ropes or lassos are permitted, but not required, for use by the contestants. Successfully roping one of the selected animals provides a time credit for the contestants, while an unsuccessful attempt results in a time penalty. The present competitive event may be performed as a stand alone event, or may be incorporated as one of a series of events at a rodeo or other competition or event, as desired. The present western heritage competitive event actually encompasses two closely related embodiments, with slight variations between the two. The two embodiments may be run as separate events, or may be run as consecutive subsets of the same event, as desired.

Figure 1:
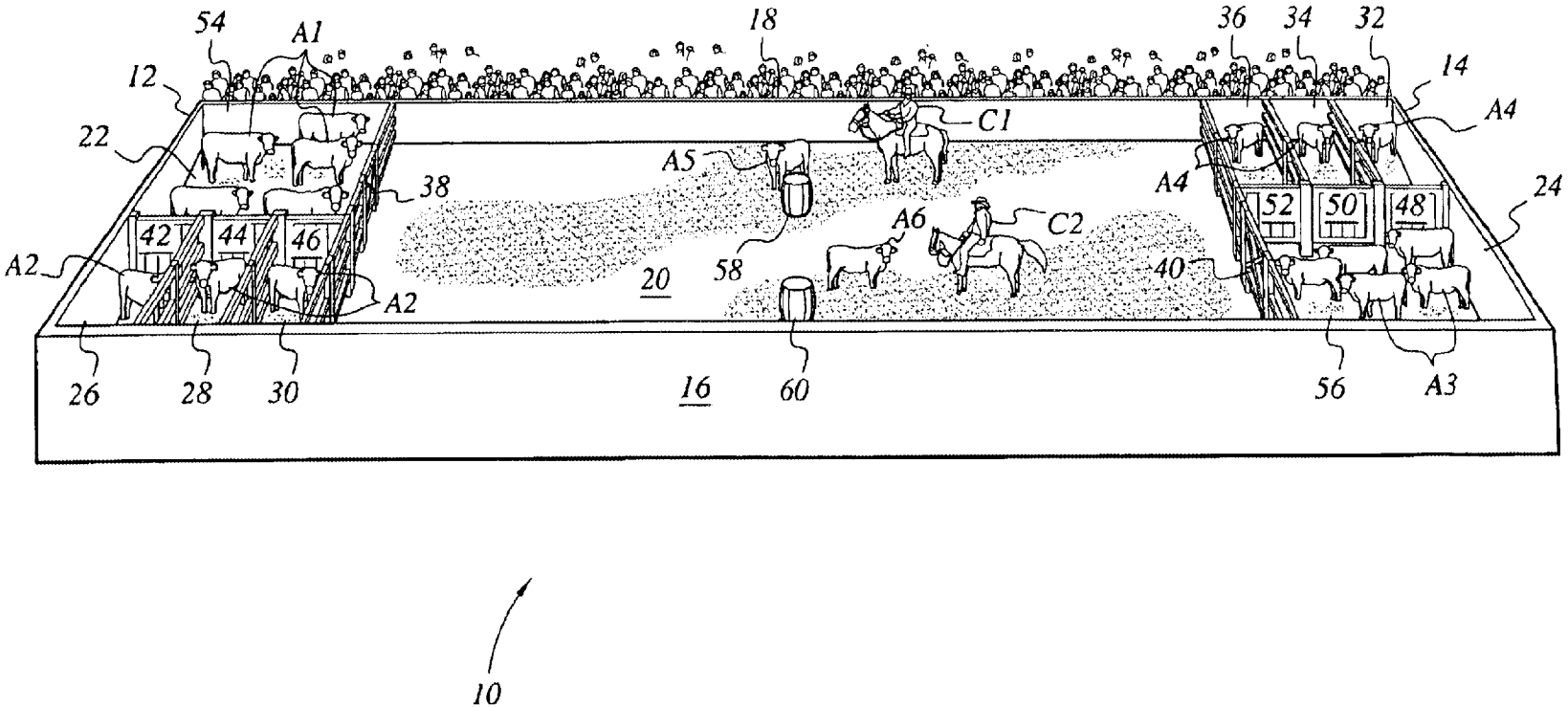
FIG. 1 is an environmental, perspective view of an arena containing appropriate equipment for the western heritage ranch sports competitive event of the present invention, and showing the event underway.
Figure 2:
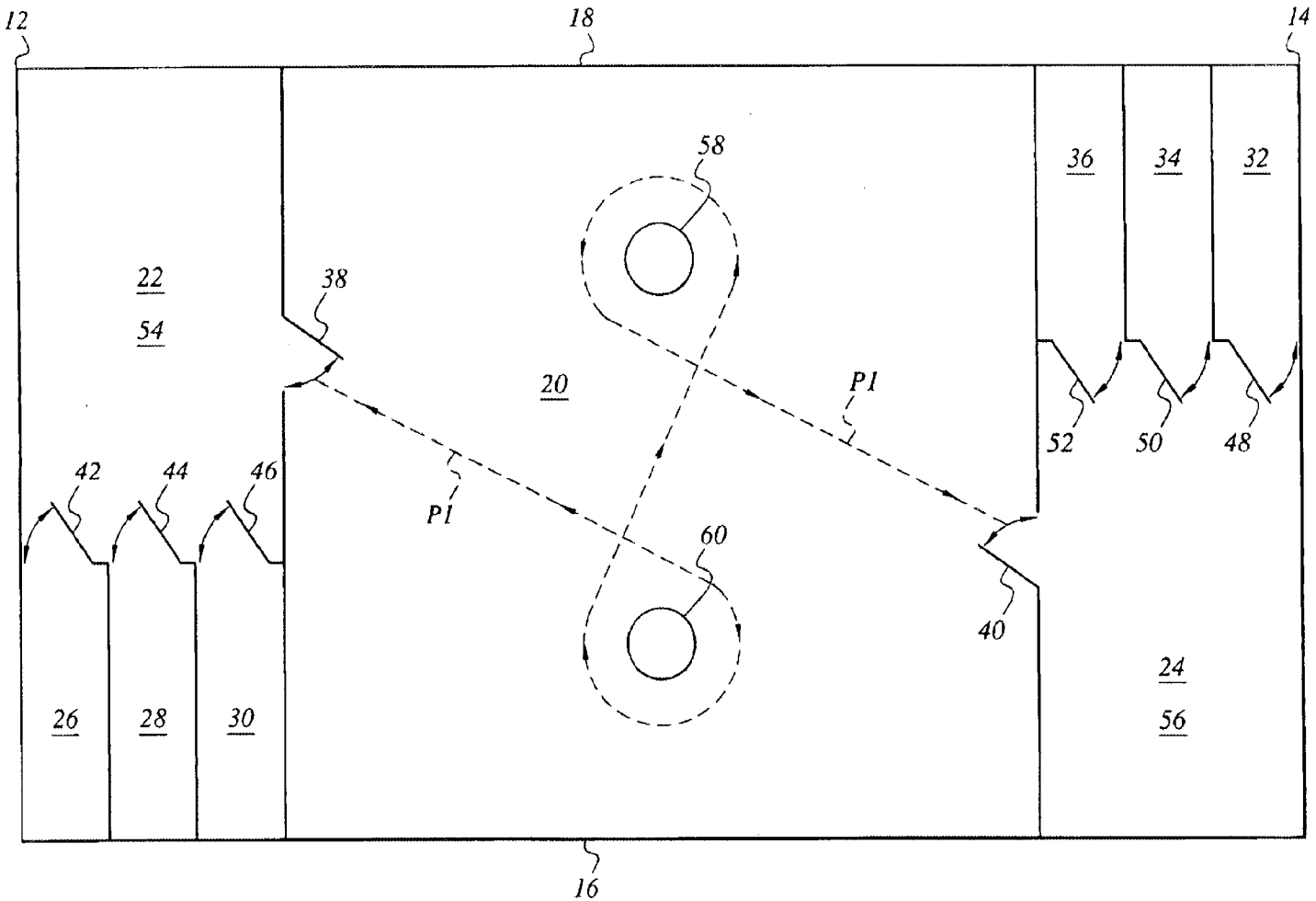
FIG. 2 is a top plan view of the arena configuration of FIG. 1, showing further details thereof.

FIG. 1 illustrates an arena 10 in which the present competitive event is taking place, with FIG. 2 illustrating a top plan view of the arena 10 of FIG. 1. The arena may be a rodeo arena or stadium, with seating for spectators and other features and amenities conventionally associated with such facilities, or may comprise a smaller and simpler area, perhaps a fenced enclosure defining the required arena as described in detail below. The arena 10 is configured conventionally, having a generally rectangular configuration with a first end 12, an opposite second end 14, a first side 16, an opposite second side 18, and a generally central area 20 defined by the two ends 12 and 14 and the two sides 16 and 18. A relatively large sorting pen 22 is located at the first end 12 of the arena 10, with an essentially mirror image second end sorting pen 24 being provided at the option of the show producers, depending upon the size and configuration of the arena 10 and the specific event.

The first end sorting pen 22 (and second end sorting pen 24, where provided) includes at least one smaller holding pen, and preferably has a series of three such holding pens therewith, indicated as first end holding pens 26, 28, and 30 in FIGS. 1 and 2. Where a second end sorting pen 24 is provided, second end holding pens 32, 34, and 36 are also provided, equivalent to the first end holding pens 26 through 30. These holding pens 26 through 36 are each of a size to contain up to ten cattle at a time therein; they are shown smaller than actual scale in the drawing Figs., in order to show other features of the present invention.

A gate, respectively 38 and 40, is provided between each sorting pen 22 and 24 and the arena central area 20, allowing the area within the two sorting pens 22 and 24 to communicate with the arena central area 20. Similarly, first end holding pen gates 42, 44, and 46 are provided respectively between the three first end holding pens 26, 28, and 30 and the first end sorting pen 22, allowing the first end holding pens 26 through 30 to communicate with the first end sorting pen 22, with second end holding pen gates 48, 50, and 52 installed between the respective second end holding pens 32, 34, and 36 and the second end sorting pen 24.

All of the various gates are selectively openable, with the two sorting pen gates 38 and 40 being opened and closed by the competitors as they herd the animals during the competition. The various holding pen gates 42 through 52 are controlled by the event staff to maintain the number of animals being held in the two sorting pens 22 and 24 at a constant number during the competition.

Figure 4:
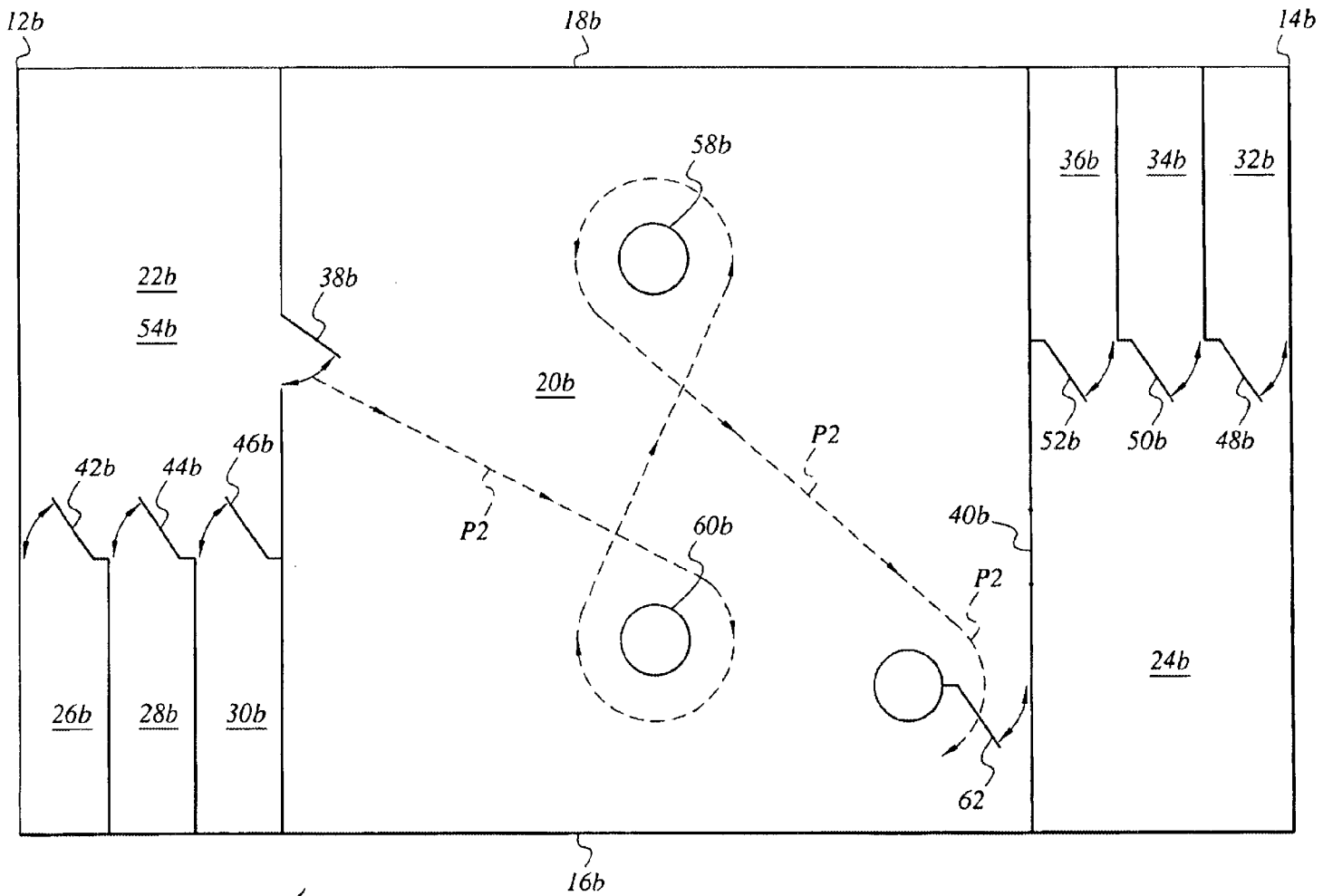
FIG. 4 is a top plan view of another alternative arena configuration, wherein a goal gate separate from the second pen or enclosure is used.
Figure 5:
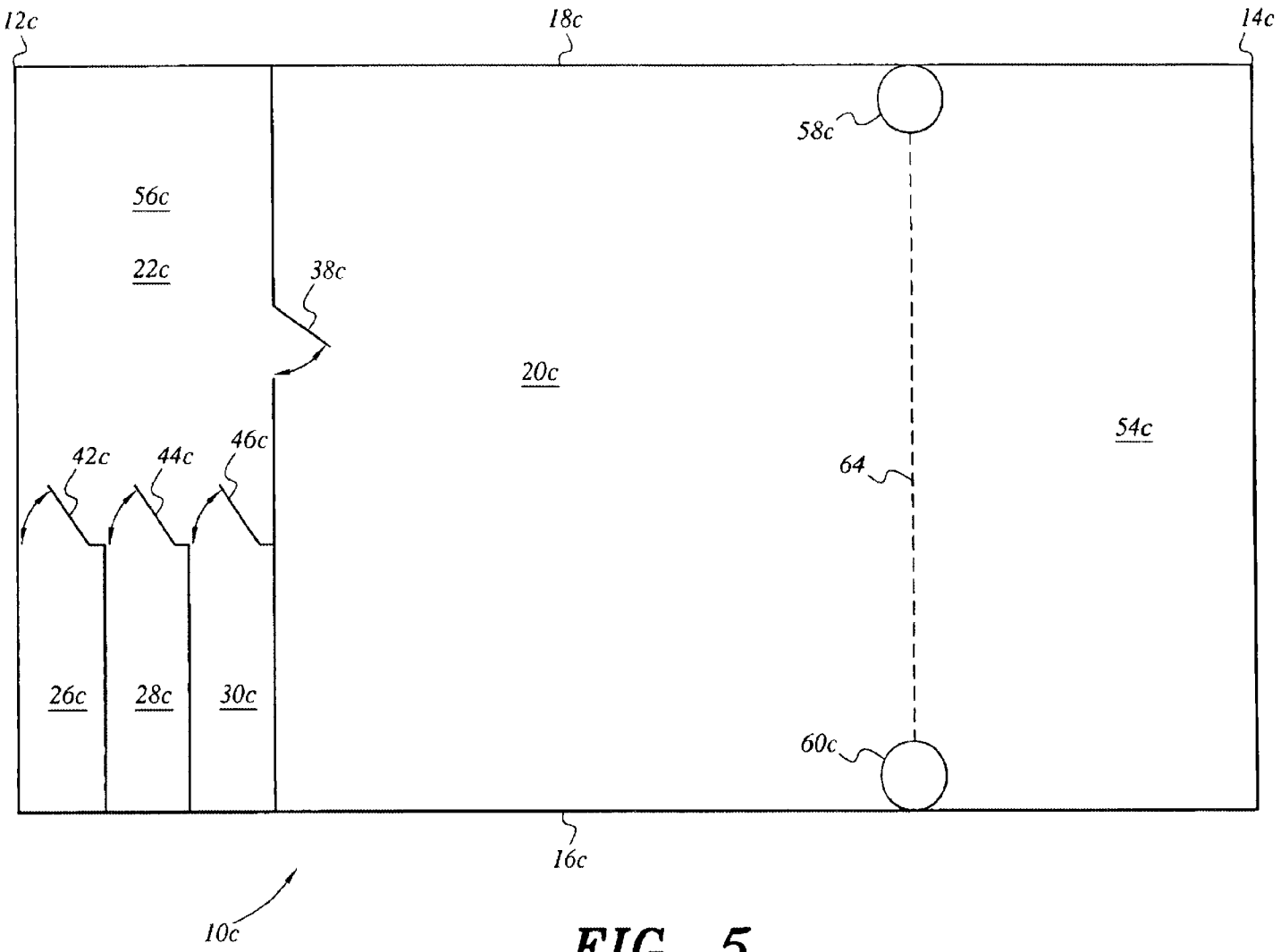
FIG. 5 is a top plan view of yet another alternative arena configuration as may be used in a second phase of the present event, in which animals are not penned in the starting area.

The present western heritage event begins in a starting area located at one of the ends 12 or 14 of the arena 10, with the specific location and/or configuration of the starting area depending upon the specific event. A goal is located generally at the opposite end of the arena 10 from the starting area. In the arena configuration of FIGS. 1 and 2, the starting area 54 is the same portion of the arena 10 as the first sorting pen 22, with the goal 56 being the location of the opposite second sorting pen 24. However, the starting area may comprise one end of the central area of the arena, as shown in FIG. 5, with the goal located in the central area outside of the sorting pen area, as shown in FIG. 4, depending on the specific nature of the event and the configuration of the arena. The configurations illustrated in FIGS. 4 and 5, and corresponding event rules, are discussed further below.

Before the event is started, a number (preferably five) of herd animals A1 (e.g., cattle) are placed within the first sorting pen 22, which also serves as the starting area 54. The first end holding pen or pens 26 through 30 are used to hold a second group of herd animals A2 therein, with the animals A2 preferably being divided among the pens 26 through 30 and used as a reserve to replenish the sorting pen herd A1 as animals are culled from that group during the competition. As noted further above, each of the holding pens 26 through 30 preferably holds a relatively large number of animals therein, e.g., ten in each of the pens 26 through 30. Only a single animal is illustrated in each of the pens 26 through 30 in FIG. 1, due to the scale of the drawing Fig.

Where the size and configuration of the arena 10 permits, a third plurality or group of herd animals A3 may be placed within the second end sorting pen 24, which also serves as the goal 56. Normally, as the competition is run, animals are transferred from the first group A1 in the first sorting pen, herded through the course provided for the event, and into the goal 54 comprising the second sorting pen 56, where they form the third animal group A3. The second set of holding pens 32 through 36 are used to hold a fourth plurality or group of animals A4, as required to run the event. The various groups of animals A1 through A4 may be transferred from their holding pens to their respective sorting pens, and herded from one sorting pen to the other, and back again, as the event progresses.

One embodiment of the present western heritage competitive event, involves the herding of one or more animals about obstacles positioned in the central area 20 of the arena 10. FIGS. 2 and 2 illustrate one variation of this type of event, wherein a pair of obstacles 58 and 60 (e.g., conventional barrels as used in rodeo events, hay bales, large traffic cones, or other clearly visible markers, as desired) are positioned substantially across the midpoint of the central area 20 of the arena 10, and spaced apart from the two sides 16 and 18. The object is for the competitors to herd the selected animals about the obstacles or barrels 58 and 60 in the minimum amount of time. However, other variations upon this embodiment, and other embodiments, may be provided, with examples of such illustrated in FIGS. 3 through 5.

Figure 3:
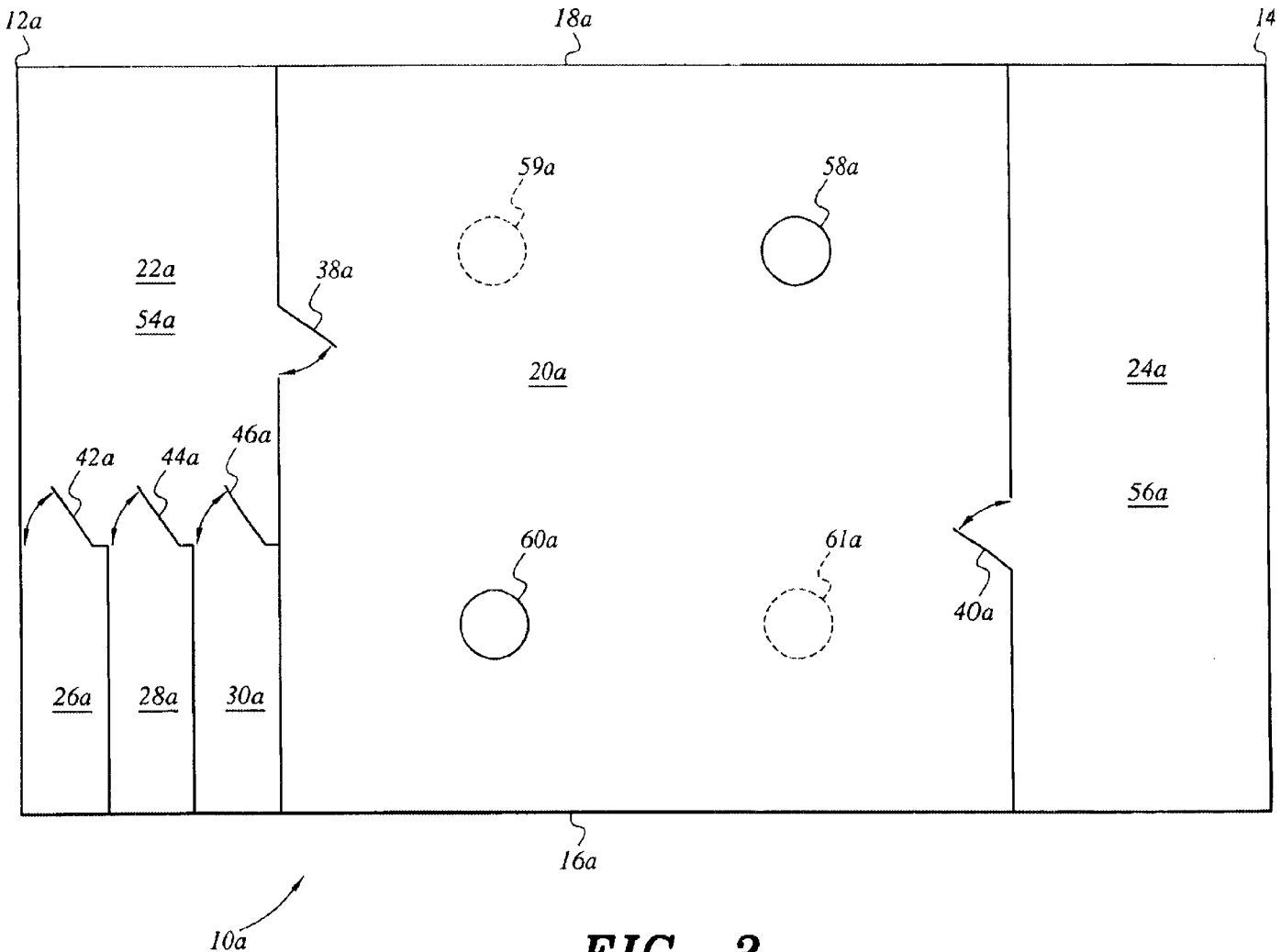
FIG. 3 is a top plan view of an alternative arena configuration, with no holding pens provided with the goal pen or enclosure.

FIG. 3 illustrates an arena 10a having a slightly different configuration from the arena 10 of FIGS. 1 and 2. The arena 10*a* of FIG. 3 includes two opposed ends 12*a* and 14*a* and two opposed sides 16*a* and 18*a*, with the ends and sides defining a cental area 20*a*. The area of the first end 12*a* has a first end sorting pen 22*a* installed therein, which may also serve as the starting area 54*a* for an event of the present invention held within the arena 10*a*. A series of first end holding pens 26*a* through 30*a* communicate with the first end sorting pen 22*a* through corresponding gates 42*a* through 46*a*, with the first end sorting pen 22*a* communicating with the central area 20*a* by means of a gate 38*a* therebetween. The configuration of the first end sorting pen 22*a*, holding pens 26*a* through 30*a*, and their respective gates 38*a* and 42*a* through 46*a*, will be seen to be identical to the corresponding components 22, 26 through 30, 38, and 42 through 46 of the arena 10 of FIGS. 1 and 2.

However, the opposite second end area of the arena 10*a* differs from the corresponding area of the arena 10 of FIGS. 1 and 2, in that no second end holding pens are provided in the arena 10*a*. The arena 10*a* of FIG. 3 has only one relatively large sorting pen 24*a* located at or within the second end 14*a* thereof, which communicates with the central area 20*a* through a gate 40*a*. While this second end sorting pen 24*a* may be used as a goal area 56*a*, animals herded into the second end pen 56*a* cannot be readily worked from the second end 14*a* back to the first end 12*a* of the arena 10*a*, as there are no holding pens to control the number of animals within the larger pen 24*a* at a constant number, for fair competition.

The configuration of the arena 10*a* of FIG. 3 differs from the configuration of the arena 10 of FIGS. 1 and 2 in another respect, as well. It will be noted that the two barrels or obstacles 58*a* and 60*a* shown in the central area 20*a* of the arena 10*a*, are staggered diagonally relative to one another. In addition, optional third and fourth obstacles 59*a* and 61*a* are shown in broken lines in the central area 20*a* of the arena 10*a*. It is not intended to imply that this arrangement of obstacles 58*a* through 61*a* illustrated in FIG. 3 is mandatory for the configuration of the arena 10*a* of FIG. 3, but only to show an alternative obstacle configuration which would define an alternative herding path for the competition. While a relatively simple herding path is preferred, as defined by the two obstacles 58 and 60 illustrated in FIGS. 1 and 2, it will be seen that any practicable number of obstacles may be used with any of the arena configurations of the present invention.

FIG. 4 illustrates yet another arena configuration, designated as arena 10*b*. The arena 10*b* of FIG. 4 has opposite ends 12*b*, 14*b* and opposite sides 16*b*, 18*b* defining a cental area 20*b*. The area of the first end 12*b* has a first end sorting pen 22*b* installed therein, which may also serve as the starting area 54*b*. A series of first end holding pens 26*b* through 30*b* communicate with the first end sorting pen 22*b* through corresponding gates 42*b* through 46*b*, with the first end sorting pen 22*b* communicating with the central area 20*b* by means of a gate 38*b* therebetween.

The opposite second end 14*b* of the arena 10*b* of FIG. 4 includes a sorting pen and holding pen configuration essentially the same as that of the first end 12*b*, with a second end sorting pen 24*b* installed therein, which may also serve as the goal area 56*b*. A series of second end holding pens 32*b* through 36*b* communicate with the second end sorting pen 24*b* through corresponding gates 48*b* through 52*b*, with the second end sorting pen 24*b* communicating with the central area 20*b* by the gate 40*b* therebetween. The configuration of the first and second end sorting pens 22*b* and 24*b*, their respective holding pens 26*b* through 30*b* and 32*b* through 36*b*, and their respective gates 38*b*, 40*b*, 42*b* through 46*b* and 48*b* through 52*b*, are identical to the corresponding components 22, 24, 26 through 30, 32 through 36, 38, 40, 42 through 46, and 48 through 52 of the arena 10 of FIGS. 1 and 2.

The arena 10*b* of FIG. 4 differs from the arena 10 of FIGS. 1 and 2, in that the goal arrangement or configuration is different in the arena 10*b*. Rather than using the second sorting pen 24*b* as the goal, a separate goal gate 62 is located within the central area 20*b* of the arena 10*b*, preferably adjacent the second sorting pen 24*b* (although the goal gate 62 could be positioned at any practicable location in the arena 10*b*, as desired). The path P2 is identical to the path P1 shown in FIG. 2. Excepting the final portion through the goal gate 62. This alternative gate position may be used where the herd animals (cattle) have begun to acclimate to the conventional gate and pen locations and tend to move toward those locations, in order to add challenge for the contestants.

FIG. 5 illustrates an arena configuration for a relatively smaller arena, or for an arena which does not have the facilities for a second set of sorting and holding pens opposite the first set of pens. The arena 10*c* of FIG. 5 has opposite ends 12*c*, 14*c* and opposite sides 16*c*, 18*c* defining a cental area 20*c*. The area of the first end 12*c* has a first end sorting pen 22*c* installed therein. A series of first end holding pens 26*c* through 30c communicate with the first end sorting pen 22*c* through corresponding gates 42*c* through 46*c*, with the first end sorting pen 22*c* communicating with central area 20*c* by a gate 38*c* therebetween.

However, no second sorting pen or holding pens are provided at the second end 14*c* of the arena 10*c*. Rather, this end area is designated as the starting area 54*c* for the arena 10*c*, by positioning the obstacles 58*c* and 60*c* (barrels, hay bales, cones, etc.) at opposite sides 16*c* and 18*c* of the arena 10*c*, at some predetermined distance between the two ends 12*c* and 14*c* as desired. While only a single obstacle may be required to mark the starting line 64 which limits the starting area 54*c*, and/or the starting line 64 may be marked across the arena 10*c*, preferably a set of two obstacles 58*c* and 60*c* is used, positioned generally as indicated in FIG. 5. In this embodiment, the goal 56*c* is defined as the first or left end sorting pen 22*c*. The animals are retained behind the starting line 64 by the competitors, with the selected animal or animals being driven the length of the central area 20*c* of the arena 10*c*, and into the goal area 56*c* of the first sorting pen 22*c*.

Figure 6:
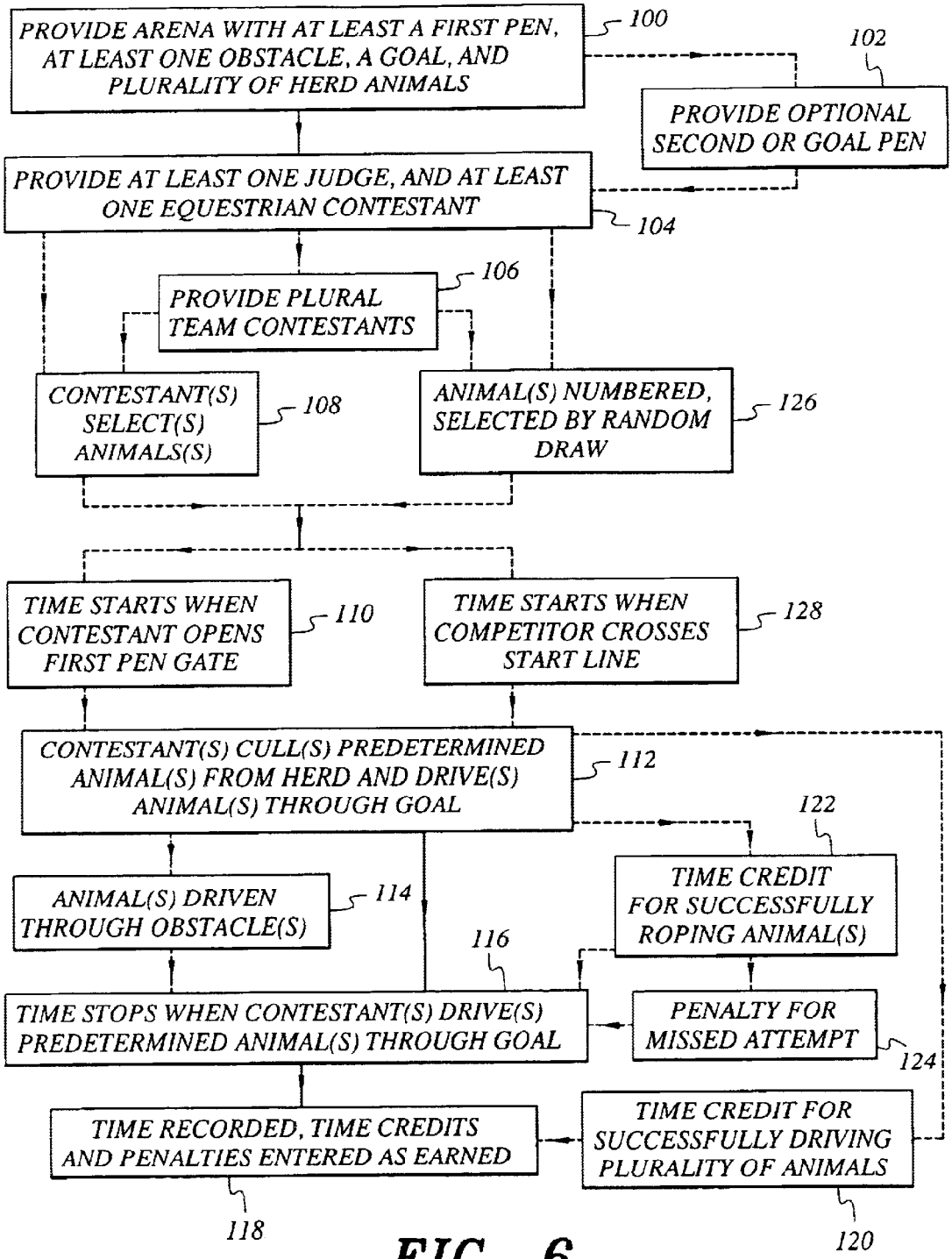
FIG. 6 is a block diagram or flow chart describing the general steps in the method of performing the present competitive western heritage ranch sports event.

FIG. 6 provides a flow chart, which when considered along with the various arena configurations described further above, provides a description of the operation of the present competitive western heritage ranch sports or rodeo event. Initially, the arena is configured in accordance with the configuration shown in one of the drawing FIGS. 1 through 5, or some other related configuration as desired. An appropriate number of herd animals (e.g., cattle, but other animals may be used) are placed within at least the first sorting pen, with a number of reserve animals being placed within the associated holding pens, for movement into the sorting pen as required. This initial step is indicated as the first step 100 of FIG. 6. The optional second step 102 of FIG. 6 indicates the installation of a second or goal pen at the opposite end of the arena, i.e. in the configuration of the arenas illustrated in FIGS. 1 through 4 of the drawings.

Once the arena has been configured as required, the required judges are positioned, and the order of participation by the contestants is determined, generally as indicated by the third step 104 of FIG. 6. All contestants are mounted on horseback for the present rodeo competition. In the event that a contestant falls or dismounts from his or her horse, that contestant must remount the horse before proceeding with the herding of the animals. Time continues to run in such a circumstance. At least one equestrian contestant will perform during each round of the event. However, it is preferred that two contestants participate simultaneously as a team, as indicated by the optional step 106 of FIG. 6. All contestants in a team, have essentially identical duties.

At this point, the procedures of the different embodiments of the present competitive event, differ somewhat from one another, depending upon the specific configuration of the arena in which the event is being held, and perhaps other factors as well. The two different event embodiments may be run as different phases of a single event and the cumulative elapsed times of the contestants added to determine an overall lowest elapsed time for the winner, or winning team, or the phases may be run as completely separate events, if so desired. Initially, the present discussion will be for a first event phase, in which all herd animals are initially confined within the first sorting pen and holding pens, e.g., the pens 22 and 26 through 30 of the arena 10 of FIGS. 1 and 2.

For this first phase event, several (preferably, five) of the animals are placed within the first sorting pen 22, with a series (preferably, ten) of reserve animals being placed within each of the associated holding pens 26 through 30. Again, the holding pens are not drawn to scale in the drawing Figs., and would be configured to hold at least ten cattle comfortably. All gates between the holding pens and the sorting pen, and between the sorting pen and central portion of the arena, are closed at this point. To begin the event, the single or plural mounted contestants enter the arena and determine which animal (or animals, in the event that the contestant(s) wish to herd two animals) will be selected from the first herd of animals A1 contained within the starting area 54 defined by the first sorting pen 22, generally as indicated by the fifth step 108 of FIG. 6.

When the judge or announcer permits the contestant(s) to advance, he/they may move to the sorting pen gate 38 and open the gate. Event timing begins when the gate is unlatched, generally as indicated by the sixth step 110 of FIG. 6. The contestant or contestants enter the first sorting pen 22, and separate or cull the selected animal(s) from the remainder of the herd A1 gathered within the first sorting pen 22, and drive the selected animal(s), designated as animals A5 and A6 in FIG. 1, through the first sorting pen gate 38 and into the central area 20 of the arena 10. The gate 38 is closed behind the selected animal(s); if more than the selected animal(s) enter the central area 20 of the arena during the competition, the competitor(s) is/are disqualified. However, any incorrect animal(s) may be driven back into the first sorting pen 22 before selecting the correct animal(s), so long as the maximum number of animals in the central area is not exceeded.

Once the selected animal(s) has/have been herded or driven into the central area 20 of the arena 10, the contestant (s) must herd or drive that animal or those animals about the obstacle or obstacles in the arena, according to a predetermined path, generally in accordance with the seventh and eighth steps 112 and 114 of FIG. 6. In the example of FIGS. 1 and 2, two obstacles 58 and 60 are provided, with the predetermined path Pi extending from the first sorting gate 38 to the second or goal sorting gate 40, and generally comprising a figure eight about the two obstacles 58 and 60. Other paths and arrangements of obstacles may be used as desired, but a relatively simple arrangement is preferred.

The object is to drive or herd the selected animal(s) into the goal area 56, defined by the second sorting pen 24 in the arena 10 configuration illustrated in FIGS. 1 and 2. FIG. 1 generally illustrates this operation, showing a pair of contestants C1 and C2 driving or herding a pair of animals AS and A6, around the obstacles 58 and 60. After completing the maneuvers around the obstacles 58 and 60, the contestant(s) drive the animal(s) to the gate 40, open the gate 40, and drive the animal(s) into the goal 56 of the second sorting pen 24, and close the gate 40 to catch or capture the animal(s) in the second sorting pen 24, whereupon timing is stopped, per the ninth step 116 of FIG. 6, and the elapsed time for the run is recorded, per the tenth step 118 of FIG. 6. Where contestants have elected to herd more than one animal through the course, a time credit (e.g., four seconds, but it may be adjusted as desired) may be issued to such contestants successfully herding and catching or capturing a plurality of animals, generally as indicated by the optional eleventh step 120 of FIG. 6.

Contestants have the option of carrying a lasso or lariat, if so desired. Successfully lassoing one or more of the animals A5 and/or A6 may provide additional time credits (e.g., two seconds), in accordance with the optional twelfth step 122 of FIG. 6. However, an unsuccessful attempt to lasso one or both of the animals, will result in a time penalty (e.g., two seconds), per the optional thirteenth step 124 of FIG. 6. This is the only equipment permitted for the contestants, other than their horses. No other equipment (e.g., whips, guns for firing blanks, etc.) may be used to startle or "haze" the cattle during the herding operation.

When the first contestant or contestants C1 and C2 has/have successfully herded or driven the animals AS and A6 through the obstacle course and into the goal pen 56, they leave the arena, and the next contestant or contestant team enters, to repeat the operation. The animals AS and A6 are placed in the first holding pen 32 located in the second end of the arena 10 to form the fourth animal group A4, where they rest until needed for another round of the event. Subsequent animals used in each round are placed within the first holding pen 32 of the second end of the arena 10 until that holding pen 32 is filled, whereupon the second holding pen 34 at the arena second end 14 is used until filled, etc.

Meanwhile, animals are removed from the second group A2 contained within the first holding pen 42 at the first end 12 of the arena 10, and placed within the first end sorting pen 22 to provide a constant number of animals A1 within that pen 22, thus providing the same challenge to all competitors in sorting or culling one or more animals from the herd Al. When all animals have been removed from the first holding pen 42, animals are taken from the second holding pen 44, and finally from the third holding pen 46, to replenish animals removed from the first group or herd A1 in the first end sorting pen 22, as they are removed by contestants during the event. In this manner, all of the animals are rotated evenly throughout the event, and remain fresh for each round. The arrangement of FIGS. 1 and 2 permits the direction of the event to be reversed, if necessary, once all animals have been removed from the first end holding pens 42 through 46.

When all contestants have completed the event, generally as described above and in the steps 100 through 124 of FIG. 6, their respective elapsed times are compared. The contestant(s) having the lowest elapsed time (including any credits for herding more than one animal, and/or successfully roping the animal, less any penalties for an unsuccessful roping attempt), win(s) the event.

Alternatively, a second phase event, with rules varying slightly from the rules described above, may be held, with contestants participating in both events and the two event times for each contestant (or team) added, or averaged, to determine the winning contestant or team. The provision of a second event, with a somewhat different arena configuration and rules, is particularly well suited for arenas where there is insufficient room to install a sorting pen and series of holding pens in the second end of the arena, as shown in FIG. 5 of the drawings.

The arena 10*c* illustrated in FIG. 5, may still be used for the conduct of the first phase event, as described further above and in the first thirteen steps 100 through 124 of the flow chart of FIG. 6. However, rather than retaining the animals used in the competition within a holding pen, an open area 54*c* is defined beyond a line 64 across the arena 10*c*. This open area 54*c* is used as the starting area for the second type of event, described below, but may also serve as the goal for the first event. Where the animals have become accustomed to leaving the arena at the second end 14*c*, they will tend to remain in the area 54*c* as the competition progresses.

Once the first phase is complete, i.e., herding the animals from the first end sorting pen, through and around the obstacles, and into the goal area at the opposite end 14*c* of the arena 10*c*, the second phase may be held. The arena 10*c* is easily reconfigured for the second phase, by repositioning the obstacles 58*c* and 60*c* used for the first phase, adjacent the opposite sides 16*c* and 18*c* of the arena 10*c*. These two obstacles 58*c* and 60*c* are used to define a start line 64 therebetween, and extending across the arena 10*c*. The animals previously herded or driven from the sorting pen 22*c*, have congregated at the second end 14*c* of the arena 10*c*, generally in the second phase starting area 54*c* as shown in FIG. 5. The first end sorting pen 22*c*, at the opposite end of the arena 10*c* from the open starting area 54*c*, becomes the goal 56*c*.

Selection of animals for contestants, is handled differently for this second competitive phase than for the first phase described further above. In the second phase, the animals are marked in some conspicuous manner, e.g., attaching large numbered tags to their flanks, as is done conventionally in cattle auctions and the like. A starting line judge holds a corresponding set of numbered cards. Contestants select the animal(s) to be herded or driven, by random lot, by blindly selecting a card for each animal to be driven or herded by that contestant or those contestants, generally as indicated by the fourteenth step 126 of FIG. 6. The contestant(s) note the number(s) drawn, and retain the card(s) to present to a checking judge at the end of their round, to confirm that the correct animals were selected and herded to the goal.

Once the subject animal(s) has/have been determined, the judge provides a starting signal. Time starts when the contestant(s) cross(es) the starting line 64, as indicated by the fifteenth step 128 of FIG. 6, into the herd which has gathered in the starting area 54*c*. The contestant(s) is/are required to sort or cull the randomly selected animal(s) from the herd, drive or herd that animal or those animals across the starting line 64 and into the central area 20*c* of the arena, and on to the goal 56*c*, as shown generally in FIG. 5 of the drawings and indicated by the seventh step 112 of FIG. 6, which is common to both phases of the event. Time is stopped when the contestant(s) have successfully driven or herded the animal(s) into the goal area 56*c* defined by the first sorting pen 22*c* of the arena 10*c* in FIG. 5, with the animal(s) thus being captured or caught therein, and closed the gate 38*c*, generally as indicated by the ninth step 116 of FIG. 6.

It will be noted that no obstacles are positioned in the central area 20*c* of the arena 10*c*, for this second phase event. This is because under normal circumstances, this phase provides sufficient challenge to the competitor(s), without the additional difficulty of herding the animal(s) about a specific predetermined course. The additional difficulty is due to two circumstances.

One element of the difficulty is due to the natural inclination of the herd animals to congregate together. The selected animals must be herded "upstream," so to speak, away from their desire to return to the main herd gathered in the starting area 54*c*, at least initially in this phase of the competition. They will likely tend to reverse course, away from the goal.

Secondly, while the animals may naturally tend to congregate toward the second end 14*c* of the arena 10*c*, assuming that they are used to departing the arena from that end, they nevertheless will tend to roam to a certain extent. The rules of the second competitive phase of the present event, require that all animals excepting the selected animal or animals to be herded, be retained back of the starting line 64 and within the starting area 54*c*. This will prove difficult, when the attention of the contestant(s) is directed to herding the selected animal(s) from one end of the arena to the other.

Otherwise, the same rules apply to both phases of the present western heritage competitive event. Contestants may use lassos or ropes to assist in herding the animals, and may lasso the animals for time credit. However, no other equipment is allowed, and contestants are not permitted to touch or otherwise startle or "haze" the selected animals in any way. A time penalty is issued against any unsuccessful roping attempt, generally as indicated by the twelfth and thirteenth steps 122 and 124 of FIG. 6. Also, the various embodiments or phases of the present competitive event recognize the increased difficulty in herding more than a single animal at a time. Accordingly, a time credit is provided for successfully herding more than one animal in a given round, as indicated by the optional eleventh step 120 of FIG. 6. While no limit is placed herein on the number of animals which may be herded in a given round, a practical maximum is two animals, given the limited number of contestants which may participate in a team.

It will also be noted that no specific limit has been placed upon the number of contestants which may comprise a team, in either of the types or phases of the present competitive event. It will be seen that a single competitor may compete, if so desired, but as a practical matter, such a single competitor will be limited to the herding of a single animal. Moreover, in the second phase of the present event, where the herd animals are not confined within the starting area by a physical barrier, two teammates are essentially required, with one watching the herd in the starting area to retain the remaining animals in that area, while the other contestant herds the selected animal(s) to the goal. While in theory, additional contestants may be assembled to form a team, the assembly of more than two contestants within the arena for each round, is generally impractical, due to the size of the typical arena, stadium, or enclosure where the present event will be held. However, the present disclosure is not limiting as to the number of contestants or animals actually participating in an active round of the event, at any one time.

In conclusion, it will be seen that the present western heritage ranch sports event requires a large number of different skills from the competitors, as well as from their mounts. The present event requires that competitors be skilled in considerably more specialties than other western heritage and/or rodeo events, i.e., horsemanship, cattle herding and driving, working around obstacles and gates while on horseback, rope handling and lassoing while mounted, and perhaps other skills as well.

In addition to the numerous ongoing challenges to the competitors, the present western heritage ranch sports event further provides action for the audience to observe at various locations throughout the stadium. This is particularly true in the case of the second phase or type event, where the herd animals are not retained within a starting enclosure. While the present western heritage event has been generally described as a stand alone event, it will be seen that it may be performed as such, or may be incorporated as one of many different types of events held in conjunction with a rodeo or similar sporting event, as desired. The present competitive event will prove to be popular with rodeo or other audiences of all types, due to the wide variety of skills required, and the continuous action of each round of the event.

It is to be understood that the present invention is not limited to the embodiments described above, but encompasses any and all embodiments within the scope of the following claims.

I claim:

1. A method of performing a western heritage ranch sports event, comprising the following steps:

(a) providing an arena having a first end, a second end opposite said first end, a first side, a second side opposite said first side, and a generally central area defined by the first end, the second end, the first side, and the second side;

(b) further providing a first sorting pen at the first end of the arena and communicating with the central area of the arena;

(c) further providing a selectively openable sorting pen gate disposed between the first sorting pen and the central area of the arena;

(d) further providing at least one first end holding pen adjacent the first sorting pen and communicating therewith;

(e) further providing a selectively openable first end holding pen gate disposed between the at least one first end holding pen and the first sorting pen;

(f) further providing a starting area disposed adjacent one end of the arena;

(g) further providing a goal disposed generally opposite the starting area;

(h) removably placing a plurality of herd animals within the starting area of the arena;

(i) further providing a plurality of equestrian contestants;

(j) further providing at least one judge;

(k) selecting at least one of the plurality of herd animals within the starting area of the arena;

(l) culling the selected at least one of the plurality of herd animals from the other herd animals, by at least one of the equestrian contestants;

(m) herding the selected at least one ofthe plurality of herd animals by the at least one of the equestrian contestants, from the starting area to the goal;

(n) recording the elapsed time required for culling and herding the selected at least one of the plurality of herd animals from the starting area to the goal;

(o) repeating the steps (k) through (n) for subsequent contestants; and (p) comparing the elapsed times of all of the contestants, and determining a winner of the event according to the lowest one of the elapsed times.

2. The method of performing a western heritage ranch sports event according to the method of claim 1, further including the steps of:

(a) forming teams of plural equestrian contestants;

(b) selecting at least two of the plurality of herd animals within the starting area of the arena;

(c) culling the selected at least two of the plurality of herd animals from the other herd animals, by at least one of the equestrian contestants; and (d) herding the selected at least two of the plurality of herd animals by the at least one of the equestrian contestants, from the starting area to the goal.

3. The method of performing a western heritage ranch sports event according to the method of claim 1, further including the steps of:

(a) providing at least one adjustably positionable obstacle;

(b) placing the at least one adjustably positionable obstacle within the central area of the arena;

(c) defining the first sorting pen as the starting area; and (d) herding the selected at least one of the plurality of herd animals around the at least one adjustably positionable obstacle, prior to reaching the goal.

4. The method of performing a western heritage ranch sports event according to the method of claim 1, further including the steps of:

(a) providing at least one adjustably positionable obstacle;

(b) placing the at least one adjustably positionable obstacle adjacent a corresponding at least one side of the arena;

(c) defining a starting line, extending across the central portion of the arena from the at least one adjustably positionable obstacle;

(d) further defining the starting area as the portion of the arena extending from the starting line, and opposite the first sorting pen;

(e) further defining the goal as the first sorting pen; and (f) requiring that all of the herd animals except the selected animals, be retained within the starting area during the herding of the selected at least one herd animal.

5. The method of performing a western heritage ranch sports event according to the method of claim 1, further including the steps of:

(a) providing a lasso for the at least one of the equestrian contestants;

(b) attempting to lasso the selected at least one herd animal;

(c) awarding a time credit to the at least one ofthe equestrian contestants, for a successful roping attempt; and (d) imposing a time penalty to the at least one of the equestrian contestants, for an unsuccessful roping attempt.

6. The method of performing a western heritage ranch sports event according to the method of claim 1, further including the step of forming teams of plural equestrian contestants.

7. The method of performing a western heritage ranch sports event according to the method of claim 1, further including the steps of:

(a) selecting at least two of the plurality of herd animals within the starting area of the arena;

(b) culling the selected at least two of the plurality of herd animals from the other herd animals, by at least one of the equestrian contestants; and (c) herding the selected at least two of the plurality of herd animals by the at least one of the equestrian contestants, from the starting area to the goal.

* * * * *